United States Patent [19]

Keck

[11] 3,994,223

[45] Nov. 30, 1976

[54] METHOD OF FABRICATING A PRINTING BLOCK

[76] Inventor: Leo Keck, Wartstrasse 12, Zurich, Switzerland

[22] Filed: Dec. 13, 1974

[21] Appl. No.: 532,385

[52] U.S. Cl. ..... 101/401.1; 264/225; 264/255

[51] Int. Cl.[2] ..... B41C 1/00

[58] Field of Search ..... 101/395, 401.1; 264/225, 245, 255

[56] References Cited

UNITED STATES PATENTS

| | | | |
|---|---|---|---|
| 1,169,985 | 2/1916 | Mickelson | 264/255 |
| 2,567,186 | 9/1951 | Cross et al. | 264/255 X |
| 3,748,202 | 7/1973 | Iisaka et al. | 264/225 X |

*Primary Examiner*—Anton O. Oechsle

[57] ABSTRACT

A method of fabricating a printing block and a printing block produced thereby wherein at a support there is produced a picture or image to be printed by application of a color mass, the applied color or ink mass is covered with a powder layer, the applied color mass being in a state permitting penetration of the powder granules, and then a printing block carrier material is applied in such a state to the support carrying the color mass provided with the adhering powder layer that the powder particles likewise can penetrate into such carrier material, so that after hardening of the printing block carrier material the powder granules are embedded in such material, then the support is separated from the hardened printing block powder material and thereafter the color mass adhering to the printing block carrier material is removed.

7 Claims, 3 Drawing Figures

METHOD OF FABRICATING A PRINTING BLOCK

BACKGROUND OF THE INVENTION

The present invention relates to a new and improved method of fabricating a printing block and also pertains to printing blocks produced according to such method and the use thereof.

In order to fabricate a printing block for intaglio printing there are known to the art many different techniques, such as for instance woodcuts, etching, lithography, aquatint, engraving, direct etching, heliography and many others. These techniques can be classified into two groups. The one group encompasses those techniques wherein the artisan is concerned with the material of the printing block. The material of the printing block therefore is manually worked in some manner by the artisan. A print or copy produced with such printing block is generally designated as original graphics. The techniques of the other group contain photographic working steps. The prints obtained with such type fabricated block are designated as reproductions.

This subdivision of the most different technology into two groups in reality constitutes an over simplification since there are also different techniques which are closer to the one or the other of the two groups, but nonetheless they cannot be completely properly classified in one or the other of such groups.

The original graphics, also known as artistic printing graphics, are mostly used for printing smaller circulations, for so-called fine art sheets, wherein the prints are also generally produced at a hand-operated press. The highest requirements are placed upon such prints since they should not only constitute information, but rather also reproduce the handwriting of the artisan as faithfully as possible. The situation is different in the case of a reproduction which must be reproduced in large series only for information purposes, however not for any artistic value.

The requirements placed upon obtaining as good as possible print are that such be as true or faithfully to the original as possible. By means of the present day conventional photographic techniques for the fabrication of reproductions it is possible to obtain very good reproductions of an original, but nonetheless what is missing from such reproduction is the application of an ink or color and therefore possesses an inherent surface structure, i.e. also a depth extension of the image or picture, in other words a spatial graining.

In order at the present time to be able to produce prints of such quality, in other words original prints, a great expenditure is required until the printing block is completed. For the printing block there can be used the most different materials, such as for example wood, zinc, lead, stone, steel, copper and so forth. The picture to be obtained can be formed by carving or cutting out, incising or cutting-in, engraving, scraping away and by further manual material-removing or material-displacing work. This work can be further supplemented by a chemical operation through etching. In order to obtain as fine as possible depth gradation, it is also possible to supplement this manual work, which has been amplified by a chemical working operation, still with photographic working steps, such as, for instance, in the case of heliography. With this very consuming technique it is possible to obtain a very fine depth gradation of the image or picture to be obtained; hence the artisan has great possibilities of imparting to the image or picture to be produced his artistic expression. It should be apparent that this technique is very complicated and hence correspondingly expensive.

SUMMARY OF THE INVENTION

Hence, it is a primary object of the present invention to provide an improved method of producing a printing block in a manner avoiding the aforementioned drawbacks.

Now in order to implement this and still further objects of the invention, which will become more readily apparent as the description proceeds, the inventive method is manifested by the features that there is produced upon a support or substrate through the application of a mass of color a picture or image to be printed, this color mass is covered with a powder layer, and the applied color mass is in a state permitting penetration of the powder granules of the powder. Then there is applied a printing block carrier material to the support carrying the color mass having the thereto adhering powder layer and which carrier material is in such a state that the powder granules likewise can penetrate into such material, so that after hardening of the printing block carrier material the powder granules are embedded in this material. Then the support is separated from the hardened printing block carrier material and thereafter the color mass adhering to the printing block carrier material is removed.

As far as the printing block produced according to the inventive method is concerned such is manifested by the features of a plate having therein portions of different depth, the surfaces of which are formed by arranging next to one another point-like raised portions and valleys, whereby these raised portions are constituted by the powder granules, parts of which are freely exposed and the remaining parts of which are embedded in the plate.

This printing block therefore possesses a predetermined contour for printing which is formed by arranging the granules next to one another. These granules are fixedly held in position by the remaining plate material when such is hard. This contour formed of granules, during printing, is provided with any suitable printing color or ink which then during printing is transferred for instance to a paper.

Such printing block is particularly suitable for intaglio printing, although of course there can be also produced with such printing block, a combined intaglio- and relief print. In the last-mentioned case the part of the printing block surface at which, during the production of the printing block, there was in contact the support which later is removed, is also provided with printing color or ink.

BRIEF DESCRIPTION OF THE DRAWING

The invention will be better understood and objects other than those set forth above, will become apparent when consideration is given to the following detailed description thereof. Such description makes reference to the annexed drawing wherein the exemplary embodiment has been shown on an exaggerated scale and wherein.

DETAILED DESCRIPTION OF THE PREFERRED EMBODIMENTS

Figure 1:
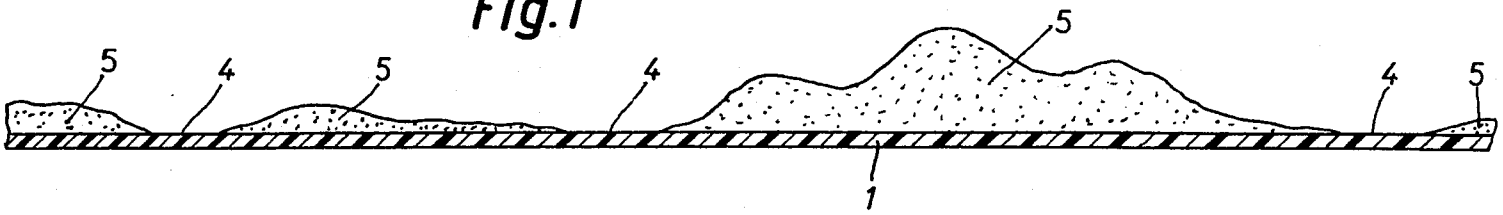
FIG. 1 is a cross-sectional view through a support upon which there has been produced by the artisan a picture or image to be printed, by the application of color.

Describing now the drawing there will now be discussed the process of fabricating a printing block. For such manufacture there is used as the support or substrate 1 a plastic foil, as the powder a glass powder 2 and as the printing block carrier material a casting resin 3, for instance the commercially available trademark product "ARALDIT". The foil 1 possesses a highly polished surface 4. On this surface the artisan draws his picture by the application of color or ink or the like. This color application results in the formation of the color mass 5. Then on the foil 1 provided with the color mass 5 there is strewn or poured glass powder 2, and specifically during such time as the color mass 5 is in a state permitting penetration of the glass granules 2*a* of the glass powder 2. This can take place during such time as the colour mass 5 is still wet; it can however also occur after the color mass 5 is already dry if prior to application of the glass powder 2 the color mass 5 is again made pasty or doughy by any suitable measures.

In the embodiment under discussion there is employed commercially available glass powder 2 which contains granules 2*a* of different sizes. If the glass powder 2 is poured onto the still wet or again pasty color mass 5, then the glass granules 2*a* can penetrate into the color mass 5. At the locations where the application of the color or the like is only very thin then only the very fine and the finest glass particles can be held, since the foundation is not adequate for retaining the larger and heavier glass granules. At the locations where there is a thicker application of the color mass or the like also the larger and largest glass granules can penetrate sufficiently deeply into the color mass so that they are retained at such locations. The fine and finest glass granules or particles which drop onto the thick color application locations of course still lie at the base of the coarser glass granules or are completely enveloped by the thick color or ink mass. If the thus prepared foil is subjected to a blowing action or simply tilted, then there drops-off all of the glass powder which is not retained by the color mass 5. What remains is a color mass 5 covered with numerous glass granules or particles, as such has been shown in FIG. 2. The contour at the locations of the thick color application is formed by the surfaces of the coarser glass granules and the contour at the locations of the thinner color application is formed by the surfaces of the smaller and smallest glass particles or granules..

Figure 2:
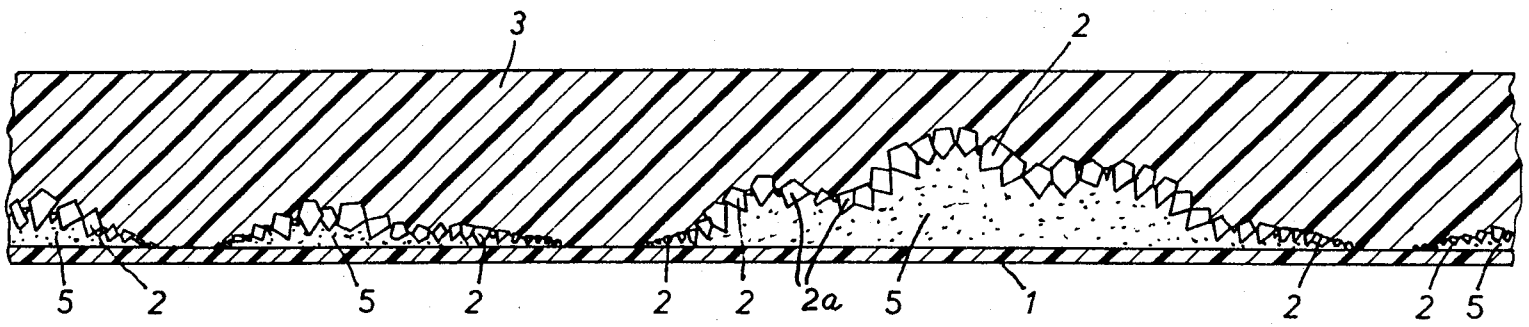
FIG. 2 is a cross-sectional view through the support and the thereto applied color according to FIG. 1 after there has been also applied a powder layer and thereon a printing block carrier material.

Now onto the thus prepared picture or image of the artisan there is applied the printing block carrier material, namely in this case the "ARALDIT" 3 in a flowable state as shown in FIG. 2. The glass granules 2 which were previously embedded in part in the in ink mass 5 are now covered at their previously free surfaces by the "ARALDIT" 3, so that the glass granules 2 are now also embedded in the "ARALDIT" mass. After hardening of the "ARALDIT" 3 the glass granules 2 are fixedly held in the"ARALDIT" 3.

Now the foil 1 is drawn-off of the article appearing in FIG. 2. During removal of this foil 1 the color mass 5 can be partially also removed; in most cases it is divided, so that a part is drawn-off of the foil 1 and a part of the color mass 5 remains at the remaining parts 2 and 3. All of the color mass 5 still adhering to the glass granules 2 is now, for instance, released and removed by washing. The color mass 5 therefore can be for instance a water soluble ink or dye; the release of the color mass from the glass particles 2 can however also take place by means of a different liquid. If all of the color mass 5 has been washed out, then there is formed the finished printing block according to FIG. 3.

This finished printing block possesses highly smooth surfaces 6 which have been formed by the highly smooth or polished surfaces 4 of the foil 1. The recessed locations of such printing block are formed by surfaces of different size raised portions corresponding to the embedded different size glass granules or particles. This means that during inking of the printing block by means of any suitable printing ink of dye such fills the deeper valleys between the larger glass granules and the flatter valleys between the smaller and smallest glass granules. This again means that between the larger glass granules there is retained a greater amount of printing ink in the printing block than between the fine and finest glass granules. In this way during printing there are also again formed locations with more printing ink and then again locations with less printing ink. Due to such different take-up of printing ink by the printing block and therefore also again different release or transfer of the printing ink there again can be reproduced during printing the shading or brightness values selected by the artisan when applying the ink according to FIG. 1, and specifically in the finest gradation. With such printing block as shown in FIG. 3 there can be produced very fine halftones which cannot be attained with an aquatint technique, not even with the very complicated heliography.

Figure 3:
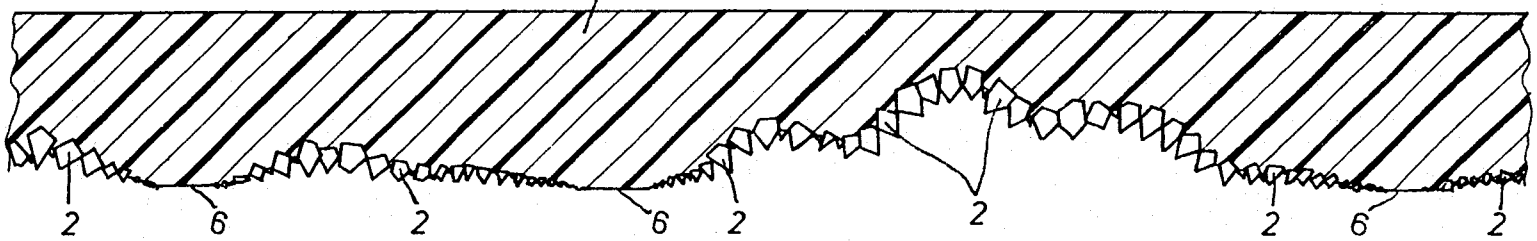
FIG. 3 is a cross-sectiona view of part of the finished printing block.

Tests have shown that the artisan when creating his picture can draw with very thin color or ink; even water colors can be applied in this manner to a printing block according to FIG. 3. The artisan is free in the selection of the type of color as concerns the consistency of such color or ink. Thus, the artisan can work, for instance, with the standard lithographic india ink. He can however use also viscous color or ink and very thin color or ink. Since he is not limited in any way to a certain color or ink consistency the artisan also in this case is free to produce the picture according to a drawing or drafting technique which he considers to be desirable. He can also work with chalk. What is important is only the fact that for producing the picture there is applied a mass to a support. Hence, it is to be understood that the employed expression "color application" or equivalent terminology is intended to convey such application of a mass. This color or ink mass of course can be colorless if such nonetheless permits producing a picture. Thus, it would, be for instance, possible to draw or draft with a colorless mass upon a support, and after the application of such mass such becomes dull, so that it lifts-off from the highly polished support. In this case the picture is drawn with a colorless mass.

The artisan draws the picture non-reversed upon the support 1. This is very important since the artisan must not work in a reversed illustration. Writing characters, for instance, signatures and so forth therefore need not be produced in a reversed manner by the artisan. If the artisan has formed the picture on the support 1 of FIG. 1 then it is possible for him in a simple manner and at any time to apply corrections and changes. If for instance there is used a water soluble color mass 5 then it will be immediately understood how simply in this case the color mass again can be removed. Hence, the artisan has adequate time to draw the picture exactly in the form which suits him best. In the event that the artisan desires to continue with the production of the printing block only after drying of the colour mass 5, then he must bring the color mass 5 again into such a condition or state that then the glass granules 2 can penetrate into the color mass 5. Depending upon the nature of the color mass 5 in this case there can be employed different techniques. Hence, there come under consideration for instance heating or a precipitation of water vapor and so forth.

The powder applied to the color mass 5 can consist of different materials. Good results have also been obtained with cement powder. The aforementioned glass powder 2 has however proven to be better since it renders possible the production of finer halftones during printing. The glass granules are also very hard, so that even after numerous copies or prints the graining or granulation remains unchanged. It is therefore also advantageous if the granules 2 consist of a relatively hard material.

As the support 1 there likewise can be employed different materials in different thicknesses. Thin foils have been found to be suitable for this purpose, it being very advantageous if the surface 4 is highly polished or smooth since then it is possible to also produce a printing block according to FIG. 3 having a highly polished smooth surface 6 in order during printing to avoid halftones at undesired locations. Instead of a foil the support 1 also can be formed of another elastic material, such as for instance "PLEXIGLAS" or "PLEXIGUM". The selection of the material for the support 1 naturally also depends upon the selection of the printing block carrier material 3 since both materials must release from one another.

The printing block carrier material 3 can be synthetic resin; casting resins have been found to be suitable, and specifically the epoxy casting resins, of which one is known commercially under the trademark "ARALDIT" and is readily available on the market. However, there can also be used a polyester casting resin. It is very advantageous if the printing block carrier material 3 is reinforced for instance with glass fibers. The fabricated printing block then cannot break as easily and it can be handled more easily.

The color mass 5 can be both water soluble as well as soluble by means of another liquid.

If the printing block of FIG. 3 has been fabricated then the artisan can still apply amplifications or corrections thereto according to any one of the known techniques. Thus, he can etch cut-out, scrape-off and cover at the printing block.

From one such printing block according to FIG. 3 it is likewise possible to produce in known manner further printing blocks, for instance galvanically. This then would be done, for instance, if the image or picture present at the printing block should be printed in larger series, thus for instance when printing fabrics. The production of the printing block according to FIG. 3, apart from the production of individual fine art sheets, smaller circulations, naturally is also suitable for the printing of fabrics for instance by means of a hand-operated press. If, for instance, the picture to be drawn on the support 1 is formed by the application of a thicker color mass 5, then for drawing there is used for instance a very viscous color, and there is produced a printing block having likewise very deep locations. Hence, it is possible to retain a great deal of color at desired locations of the printing block, so that there can be carried out a very precise printing of fabrics.

The explained method for the production of a printing block is also therefore very interesting for the printing of fabrics, since for example when using a transparent support 1 it is possible to draw with a first color a picture or ornament. With a second likewise transparent support 1 there is then again drawn a given design or pattern by means of a second color.

Upon a further third support it is possible to again draw with a further color a given design or pattern and so forth. If then in this case the aforementioned three supports are then brought in overlying relationship, then also all three different color designs are brought into overlying relationship. The artisan can then easily see whether the now visible resultant design corresponds to his conception of the pattern to be produced for the fabric printing. It is possible for him according to his desires to change each support until he has arrived at the desired design or pattern, as such is visible when he has brought into superimposed relationship all of the supports. Then with the embodiment under discussion the three different printing blocks are fabricated in the desired manner. In this way it is possible for the artisan to produce any given design for multicolor-fabric intaglio printing.

If the inventive printing block is used for a combined relief and intaglio printing, then the recesses are colored with the printing ink and the surface 6 with another printing ink, so that by virtue of the fine and finest powder granules 2 located near to the surface 6 there is printed a soft non-abrupt transition. The attainment of the fine halftones also in this case can be of advantage. The same holds true when the printing block is only used for relief printing, in other words when only the surface 6 is provided with printing ink. Also in this case it is possible to print halftones.

While there is shown and described present preferred embodiments of the invention, it is to be distinctly understood that the invention is not limited thereto, but may be otherwise variously embodied and practiced within the scope of the following claims.

What is claimed is:

1. In a method of reproducing a picture, the steps of providing a support with a smooth surface, creating a picture on said surface with a mass, pouring a powder with powder granules of different sizes onto said mass while the latter is in a state in which it can be penetrated by said granules, so that a layer of granules of different sizes will adhere to said mass, removing from said mass powder which does not adhere to said mass, applying a flowable, hardenable material onto said mass and the powder layer, hardening said material so that the powder granules become embeded in said material, and separating the support and mass from the hardened material and powder granules embedded therein, said hardened material with embedded powder granules forming a printing plate from which said picture can be reproduced.

2. The method as defined in claim 1, including the step of washing out the mass adhering to the printing plate after the support has been separated from the printing plate.

3. The method as defined in claim 1, wherein the support is a plastic foil.

4. The method as defined in claim 1, wherein the support is a flexible plastic plate.

5. The method as defined in claim 1, wherein said material is an epoxy casting resin.

6. The method as defined in claim 1, wherein the powder is glass powder.

7. The method as defined in claim 1, wherein the powder is cement powder.

* * * * *